US005849171A

United States Patent [19]

Dahms et al.

[11] Patent Number: 5,849,171

[45] Date of Patent: Dec. 15, 1998

[54] ACID BATH FOR COPPER PLATING AND PROCESS WITH THE USE OF THIS COMBINATION

[75] Inventors: Wolfgang Dahms; Horst Westphal, both of Berlin, Germany

[73] Assignee: Atotech Deutschland GmbH, Berlin, Germany

[21] Appl. No.: 720,890

[22] Filed: Oct. 4, 1996

Related U.S. Application Data

[63] Continuation-in-part of Ser. No. 479,333, Jun. 7, 1995, abandoned, which is a continuation-in-part of Ser. No. 30,395, Apr. 8, 1993, abandoned.

[30] Foreign Application Priority Data

Oct. 13, 1990 [DE] Germany ..... 40 32 864.3
Oct. 11, 1991 [WO] WIPO ..... PCT/DE91/00811

[51] Int. Cl.[6] ..... C25D 3/38

[52] U.S. Cl. ..... 205/298; 205/297; 205/296; 106/1.26

[58] Field of Search ..... 205/296, 297, 205/298; 106/1.26

[56] References Cited

U.S. PATENT DOCUMENTS

| | | | |
|---|---|---|---|
| 3,743,584 | 7/1973 | Todt et al. | 205/298 |
| 3,778,357 | 12/1973 | Dahms et al. | 205/298 |
| 4,374,709 | 2/1983 | Combs | 205/296 |
| 4,384,930 | 5/1983 | Eckles | 205/296 |
| 4,975,159 | 12/1990 | Dahms | 205/125 |
| 5,433,840 | 7/1995 | Dahms et al. | 205/296 |

*Primary Examiner*—Kathryn L. Gorgos
*Assistant Examiner*—Kishor Mayekar
*Attorney, Agent, or Firm*—Paul & Paul

[57] ABSTRACT

An aqueous acid bath for galvanic precipitation of copper is disclosed. The copper plating composition comprises at least one polymer phenazonium compound and β-naphtholalkoxylate. A method for using such a bath for deposition of copper coatings is also disclosed. The resultant copper coatings are smooth and bright with substantially no fine roughness or pitting.

30 Claims, 1 Drawing Sheet

ACID BATH FOR COPPER PLATING AND PROCESS WITH THE USE OF THIS COMBINATION

CROSS-REFERENCE TO RELATED APPLICATIONS

This application is a Continuation-in-Part of application Ser. No. 08/479,333 filed Jun. 7, 1995, which is a Continuation-in-Part of application Ser. No. 08/030,395 filed Apr. 8, 1993, now abandoned.

FIELD OF THE INVENTION

The invention relates to an acid bath for galvanic precipitation of bright and smooth copper coatings and their use.

BACKGROUND OF THE INVENTION

It has long been known that certain organic substances can be added in small quantities to acid, in particular the most widely used sulfuric acid, copper electrolytes in order to obtain bright copper coatings instead of a matte crystalline precipitation. For this purpose, for example, polyethylene glycol, thiourea, gelatins, molasses, instant coffee, "base" dyes and thiophosphoric acid ester have been used. However, such baths no longer have practical importance since the quality of the copper coatings obtained do not meet today's requirements. So these coatings are either too brittle or they are not bright enough or they precipitate in a relief formation in certain current density areas.

The addition of polyalkylimines in connection with organic thiocompounds (DE-PS 1246347) and polyvinyl compounds in a mixture with oxygen-containing high-molecular compounds and organic, in particular aromatic thiocompounds (DE-AS 1521062) is known. However, copper electrolytes of this type do not permit the use of high cathodic current densities and the precipitated copper coatings can also only be nickel-coated after a prior intermediate treatment. In the above named DE-AS 1521062, an acid copper bath is also described, which in addition to a polymer oxygen-containing compound with hydrophilic group, contains at least one substituted phenazonium compound dissolved in it. With these monomer phenazonium compounds, there is room for improvement in the current density that can be used and the aging behavior. In addition, combinations of organic thiocompounds and non-ionogenic wetting agents with other dyes, for example crystal violet (EP-PS 71512), amidene (DE-PS 2746938), phthalocyanine derivatives with aposafranine (DE-PS 3420999) are known. Instead of dyes, undefined conversion products of polyamines with benzylchloride (DE-PS 2541897) and/or epichlorhydrine (EU-PS 68807) or those with thiocompounds and acrylamide (EU-PS 107109) are used.

The previously known baths all produce non-uniform deposits; this is particularly true of the combination with thiocompounds containing nitrogen.

Baths that contain polymer phenazonium compounds (DE-PS 2039831) resulted in progress; these are mainly used in combination with non-ionogenic wetting agents and organic sulfur compounds.

In fact, it is the state of the art to add non-ionogenic wetting agents to the acid copper baths, however this did not eliminate the fine roughness.

The use of β-naphthol-polyglycolether as an addition to a copper bath will be disclosed in DE-OS 37 21 985 (Example 2) and GB-A-2075063, but not in combination with polymer phenazonium compounds.

DE-PS 3104108 describes a fluoroborate bath that contains β-naphtholethoxylate in combination with a phthalocyanine dye. The electrolyte itself shows only a moderate smoothing in comparison to polymer phenazonium compounds. With high smoothing, the disadvantage of these baths is a fine roughness (pitting, nodules) on the coating, which seriously impairs the decorative appearance, particularly of large-surface parts. This roughness does not result from floating particles in the electrolyte, rather it is a result of a defective precipitation in the cathodic double layer. This occurs especially with nitrogen-containing sulfur compounds (so-called thiourea derivatives) and with phenazonium compounds.

U.S. Pat. No. 3,778,357 to Dahms et al., which is incorporated herein by reference, is related to electrolytes for plating copper comprising phosphonium compound addition agents.

U.S. Pat. No. 4,384,930 to Eckles, which is incorporated herein by reference, is related to electroplating baths for depositing metals such as tin and/or lead.

U.S. Pat. No. 4,374,709 to Combs, which is incorporated herein by reference, discloses a process for plating polymeric substrates including an intermediate step using an acid copper strike bath.

The task of this invention is to prevent the disadvantages described and additionally not to impair the advantageous smoothing.

DETAILED DESCRIPTION OF THE PREFERRED EMBODIMENTS

Figure 1:
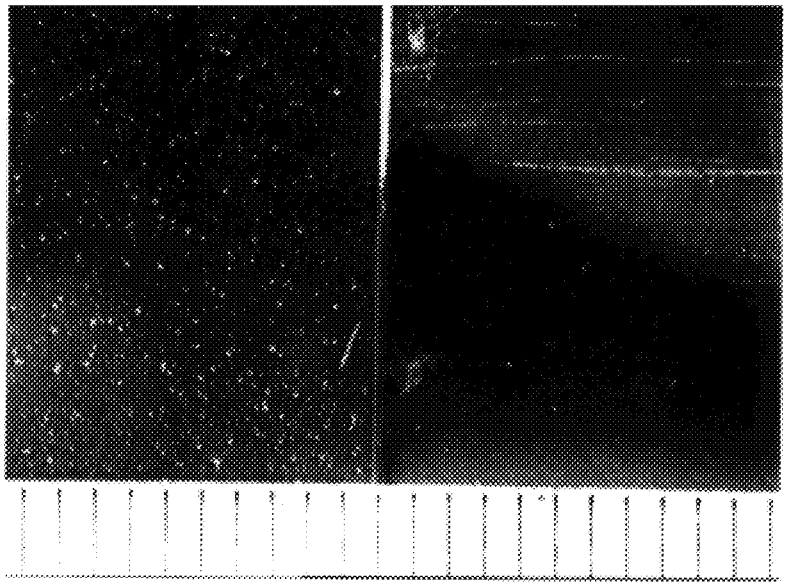
FIG. 1 is a comparative scanning electron microscope (SEM) photograph showing the elimination of fine roughness from the surface of a copper coating through the use of a β-naphtholalkoxylate-containing plating composition of the present invention. The right portion of the micrograph corresponds to a copper surface produced with a plating composition of the present invention, wherein a bright and smooth surface with no fine roughness or pittings is achieved.

According to the present invention, an acid bath is used that contains at least one mixture consisting of β-naphtholalkoxylate of the general formula I:

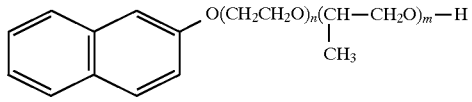

in which n=0–50, preferably 10–25, and m=0–50, preferably 0–10, wherein n+m≧3, thiourea or thiourea derivative and polymer phenazonium compound.

Table 2 contains examples of nitrogen-containing thiocompounds (so-called thiourea derivatives) or heterocyclic compounds containing S and N and Table 3 of polymer phenazonium compounds.

Compounds of

TABLE 1

| | | |
|---|---|---|
| β-Naphthol-tetracosa (ethoxylate) | n = 24; | m = 0 |
| β-Naphthol-eicosa (ethoxylate) | n = 20; | m = 0 |
| β-Naphthol-octadeca (ethoxylate) | n = 18; | m = 0 |
| β-Naphthol-hexadeca (ethoxylate) | n = 16; | m = 0 |

TABLE 1-continued

| | | |
|---|---|---|
| β-Naphthol-tetradeca (ethoxylate) | n = 14; | m = 0 |
| β-Naphthol-trideca (ethoxylate) | n = 13; | m = 0 |
| β-Naphthol-dodeca (ethoxylate) | n = 12; | m = 0 |
| β-Naphthol-deca (ethoxylate) | n = 10; | m = 0 |
| β-Naphthol-octa (ethoxylate) | n = 8; | m = 0 |
| β-Naphthol-hexa (ethoxylate) | n = 6; | m = 0 |
| β-Naphthol-tetracosa (propoxylate) | n = 0; | m = 24 |
| β-Naphthol-tetracosa (ethoxy) -mono (propoxylate) *) | n = 24; | m = 1 |
| β-Naphthol-octadeca (ethoxy)-di (proproxylate) *) | n = 20; | m = 2 |
| β-Naphthol-mono (propoxy)-tetracosa (ethoxylate) *) | n = 24; | m = 1 |
| β-Naphthol-di (propoxy)-octadeca (ethoxylate) *) | n = 20; | m = 2 |
| +) mixed or block polymeride | | |

are particularly suited as β-naphtolalkoxylate of the general formula I.

Thiourea and thiourea derivatives and heterocyclic compounds containing S and N are used as nitrogen containing thiocompounds.

Table 2 contains examples of nitrogen-containing thiocompounds (so-called thiourea derivatives) and Table 3 of polymer phenazonium compounds.

Table 2

Thiourea
N-Acetylthiourea
N-Trifluorocetylthiourea
N-Ethylthiourea
N-Cyanoacetylthiourea
N-Allylthiourea
O-Tolylthiourea
N,N'-Butylenethiourea
Thiazolidinethiol (2)
4-Thiazolinethiol (2)
Imidazolidinethiol (2) (N,N'-Ethylenethiourea)
4-Methyl-2-pyrimidinethiol
2-Thiouracil Table 3

Poly(6-methyl-7-dimethylamino-5-phenyl-phenazonium sulfate)
Poly(2-methyl-7-diethylamino-5-phenyl-phenazonium chloride)
Poly(2-methyl-7-dimethylamino-5-phenyl-phenazonium sulfate)
Poly(5-methyl-7-dimethylamino-phenazonium acetate)
Poly(2-methyl-7-anilino-5-phenyl-phenazonium sulfate)
Poly(2-methyl-7-dimethylamino-phenazonium sulfate)
Poly(7-methylamino-5-phenyl-phenazonium acetate)
Poly(7-ethylamino-2,5-diphenyl-phenazonium chloride)
Poly(2,8-dimethyl-7-diethylamino-5-p-tolyl-phenazonium chloride)
Poly(2,5,8-triphenyl-7-dimethylamino-phenazonium sulfate)
Poly(2,8-dimethyl-7-amino-5-phenyl-phenazonium sulfate)
Poly(7-Dimethylamino-5-phenyl-phenazonium chloride)

For the solutions according to the invention, mixtures of the compounds listed in Tables 1, 2 and 3 are used. The preferred quantity of the β-naphtholethoxylate that must be added in order to achieve a clear improvement in copper precipitation is about 0.005 to 3 g/liter, preferably 0.01 to 0.25 g/liter.

The β-naphtholethoxylates are known or can be produced using methods known in and of themselves from β-naphthol with ethylene oxide and/or propylene oxide.

The individual components of the copper bath according to the invention can generally contain the following, advantageously within the following limit concentrations in the ready-to-use bath:

| | |
|---|---|
| Standard oxygen-containing high-molecular compounds, preferably | 0.005–20 g/liter<br>0.01–5 g/liter |
| Standard organic thio-compounds with hydrophilic groups preferably | 0.005–0.2 g/liter<br>0.001–0.03 g/liter |
| Standard nitrogen-containing thiocompounds (so-called thiourea derivatives) and/or polymer phenazonium compounds preferably | 0.0001–0.50 g/liter<br>0.0005–0.04 g/liter |

The basic composition of the bath according to the invention can vary within wide limits. In general, an aqueous solution of the following composition is used:

| | |
|---|---|
| Copper sulfate ($CuSO_4 \cdot 5H_2O$) | 20–250 g/liter |
| preferably | 60–80 g/liter or<br>180–220 g/liter |
| Sulfuric acid | 50–350 g/liter |
| preferably | 180–220 g/liter or<br>50–90 g/liter |
| Sodium chloride | 0.02–0.25 g/liter |
| preferably | 0.05–0.12 g/liter |

Instead of copper sulfate, other copper salts can also be used, at least in part. Sulfuric acid can also be partially or completely replaced by fluoroboric acid, methane sulfonic acid or other acids. The addition of sodium chloride can be omitted partially or entirely if halogen ions are already contained in the additives. In addition, standard brighteners, smoothing agents or wetting agents can also be contained in the bath. To produce the bath according to the invention, the individual components are added to the basic composition. The operating conditions of the bath are as follows:

| | |
|---|---|
| Ph value: | <1 |
| Temperature: | 15° C.–45° C., preferably<br>20° C.–30° C. |
| Cathodic current density: | 0.5–12 A/dm$^2$,<br>preferably 2–4 A/dm$^2$ |

The electrolyte motion is caused by blowing in air. Copper with a 0.02 to 0.067% phosphorous content is used as the anode.

The invention also includes processes using the baths disclosed herein.

The following examples are used to explain the invention:

EXAMPLE 1

0.2 g/liter polyethylene glycol and 0.01 g/liter bis-(w-sulfopropyl)-disulfide, disodium salt as a brightening agent and 0.02 g/liter polymer 7-dimethylamino-5-phenyl-phenazonium chloride are added to a copper bath of the composition 200.0 g/liter copper sulfate ($CuSO_4.5H_2O$)

65.0 g/liter sulfuric acid 0.2 g/liter sodium chloride.

At an electrolyte temperature of 27° C., with a current density of 4 A/dm$^2$ and air blown in, a well smoothed, bright copper coating is obtained that shows fine roughness (pitting) on polished brass sheet metal when closely examined.

If 0.025 g/liter of β-naphtolalkoxylate of the general formula I with n=12 and m=0 is also added to the bath, the plating has a mirror finish and is well smoothed. No voids can be found.

EXAMPLE 2

0.6 g/liter polyethylene glycol and 0.02 g/liter 3-mercaptopropane-1-sulfonic acid, sodium salt as a brightener and 0.003 g/liter N-acetylthiourea are added to a copper bath of the composition 80.0 g/liter copper sulfate ($CuSO_4.5H_2O$)

180.0 g/liter conc. sulfuric acid 0.08 g/liter sodium chloride.

At an electrolyte temperature of 30° C., with a current density of 2 A/dm$^2$, a bright copper coating is obtained on scratched copper laminate, on which fine roughness (pitting) is visible.

If 0.05 g/liter of the substance according to the invention of the general formula I with n=24 and m=0 is also added to the bath, the copper coating is bright and contains no faults.

The following examples further show that from acid baths for copper plating containing polymer phenazonium compounds and β-naphtholalkoxylates of the formula I according to the present invention, bright electroplated deposits can be obtained which do not exhibit fine roughness on the surface of the deposit.

EXAMPLE 3

To a copper plating bath with the following composition:

| | |
|---|---|
| copper sulfate ($CUSO_4 \cdot 5H_2O$) | 80 g/liter |
| concentrated sulfuric acid | 180 g/liter |
| sodium chloride | 0.08 g/liter |

the following compounds were added as brightening compounds:

| | |
|---|---|
| polypropylene glycol | 0.6 g/liter |
| 3-mercaptopropane-1-sulfonic acid, sodium salt | 0.03 g/liter |
| poly (6-methyl-7-dimiethylamino-5-phenyl-phenazonium sulphate | 0.004 g/liter. |

At an electrolyte temperature of 32° C., with a current density of 2 A/dm$^2$, a bright copper coating that exhibits fine roughness (pittings) is deposited on the scratched copper laminate.

If 0.05 g/liter of the substance according to the invention of the general formula I with n=24 and m=0 is also added to the bath, the deposit has a mirror finish and is bright and well smoothed.

EXAMPLE 4

To a copper plating bath with the following composition:

| | |
|---|---|
| copper sulfate ($CUSO_4 \cdot 5H_2O$) | 80 g/liter |
| concentrated sulfuric acid | 200 g/liter |
| sodium chloride | 0.06 g/liter |

the following compounds were added as brightening compounds:

| | |
|---|---|
| octyl-polyalkyl ether | 0.4 g/liter |
| bis- (ω-sulfopropyl) disulfide, disodium salt | 0.02 g/liter |
| poly (5-methyl-7-dimethylamino-phenazonium sulfate | 0.01 g/liter. |

At an electrolyte temperature of 30° C., with a current density of 2.5 A/dm$^2$, a bright copper coating is obtained on a scratched copper laminate. Using a microscope a fine roughness (pittings) with roughness dimensions of 20–40 μm can be detected on the deposit surface.

If a 0.2 g/liter of the substance according to the invention of the general formula I with n=20 and m=2 is also added to the bath after copper has been deposited onto the copper laminate, corresponding to an equivalent of 5 Ah per liter bath, no roughness is visible any longer on the surface.

EXAMPLE 5

To a copper plating bath with the following composition:

| | |
|---|---|
| copper sulfate ($CUSO_4 \cdot 5H_2O$) | 180 g/liter |
| concentrated sulfuric acid | 85 g/liter |
| sodium chloride | 0.1 g/liter. |

the following compounds were added as brightening compounds:

| | |
|---|---|
| nonylphenol-polygylcole ether | 0.4 g/liter |
| 3- (benzthiazolyl-2-thiole) -propyl-sulfonic acid, sodium salt | 0.04 g/liter |
| poly (7-methylamino-5 anilino-phenazonium chloride | 0.02 g/liter |

At a current density of 5 A/dm$^2$ and with air blown in, a bright and well levelled copper coating is obtained, which exhibits fine roughness (pittings) on large-area ABS-parts upon observation of the surface.

If 0.3 g/liter of the substance according to the invention of the general formula I with n=16 and m=0 is additionally added to the bath a mirror finish and decorative deposit without roughness on the surface is obtained on the surface of the scratched copper laminate.

The following comparative examples illustrate the unexpectedly improved results achieved in accordance with the use of β-naphtholalkoxylates of the present invention. The plating for each of the following examples is performed as described in Example 1.

EXAMPLE 6

The following plating composition in accordance with Example 2 of Dahms et al. U.S. Pat. No. 3,778,357 was prepared:

| | |
|---|---|
| copper sulfate ($CuSO_4 \cdot 5H_2O$) | 220 g/l |
| sulfuric acid, conc. | 60 g/l |
| sodium chloride | 40 mg/l |
| tributyl benzyl phosphonium chloride | 1 g/l |
| mercaptopropane sulfonic acid, sodium salt | 10 mg/l |
| polymer 2-methyl-7-dimethy-lamino-5-phenyl phenazonium sulfate | 6 mg/l |

After plating, the resultant copper coating was well smoothed and bright, but exhibited extensive fine roughness in the form of pitting, similar to the pitted surface shown in the left portion of the SEM micrograph of FIG. 1.

EXAMPLE 7

Examples 1 and 6 were repeated, except 50 mg/l of the compound β-naphthol-dodeca-ethoxylate was added to each of the baths. The resultant coatings did not exhibit pitting, and were well smoothed and shiny. No surface roughness was visible. The copper surface produced in accordance with this example (representing the addition of β-naphthol-dodeca-ethoxylate to the plating composition of Example 6) is shown in the right portion of the SEM micrograph of FIG. 1. As shown in FIG. 1, the addition of β-naphtholalkoxylate of the present invention to the plating composition disclosed in Dahms et al. U.S. Pat. No. 3,778,357 produces a smooth and bright copper coating with essentially no fine roughness or pitting.

EXAMPLE 8

Example 6 was repeated, except 50 mg/l of the compound β-naphthol-deca-ethoxylate was added to the bath. The resultant coating was smooth and bright with no fine roughness.

EXAMPLE 9

Example 6 was repeated, except 100 mg/l of the compound β-naphthol-deca-ethoxylate was added to the bath. The resultant coating was smooth and bright with no fine roughness.

EXAMPLE 10

Example 6 was repeated, except 50 mg/l of the compound β-naphthol-trideca-ethoxylate was added to the bath. The resultant coating was smooth and bright with no fine roughness.

EXAMPLE 11

Example 6 was repeated, except 100 mg/l of the compound β-naphthol-trideca-ethoxylate was added to the bath. The resultant coating was smooth and bright with no fine roughness.

EXAMPLE 12

Example 6 was repeated, except that phenol ethoxylate as disclosed by Eckles U.S. Pat. No. 4,384,930 was added to the copper plating composition. The following plating composition was prepared:

| | |
|---|---|
| copper sulfate ($CUSO_4 \cdot 5H_2O$) | 220 g/l |
| sulfuric acid, conc. | 60 g/l |
| sodium chloride | 40 mg/l |
| tributyl benzyl phosphonium chloride | 1 g/l |
| mercaptopropane sulfonic acid, sodium salt | 10 mg/l |
| polymer 2-methyl-7-dimethylamino-5-phenyl phenazonium sulfate | 6 mg/l |

with the addition of varying amounts of from 200 mg/l to 800 mg/l of the compound phenol-tetradeca-ethoxylate. No improvement over the coating deposition of Example 6 could be obtained with the phenol ethoxylate additions. In each case, the resultant coatings exhibited extensive fine roughness. A copper surface produced in accordance with this example is shown in the left portion of the SEM micrograph of FIG. 1, illustrating the occurance of fine roughness/pitting.

EXAMPLE 13

Example 12 is repeated, except β-naphtholalkoxylate of the composition and amount described in each of Examples 1, 2, 4, 5, and 7–11 is added to the plating composition. In each case, the resultant coating is smooth and bright with no observable fine roughness, similar to the smooth surface shown in the right portion of the SEM micrograph of FIG. 1. The present invention is susceptible to various changes, modifications and adaptations by those skilled in the art, and it is understood that such changes, modifications and adaptations are considered to be within the scope of the present invention as defined by the appended claims.

EXAMPLE 14

In accordance with the electrolyte of Example 1, above, the following formulation was prepared:

220 g/liter copper sulfate ($CuSO_4.5H_2O$)

65 g/liter sulfuric acid, concentrated 200 mg/liter sodium chloride 10 mg/liter Bis-(w-sulfopropyl)-disulfide, disodium salt 20 mg/liter polymer 7-dimethylamino-5-phenyl phenazonium chloride Neither the polyethylene glycol, nor the β-naphtholalkoxylate was added in Example 14. The result obtained was mat, rough deposits.

EXAMPLE 15

The following was added to the formulation of Example 14:

150 mg/liter β-naphtholalkoxylate with n=24 and m=0

The result obtained was a bright, well-smoothed deposit. No pitting or roughness was observed.

EXAMPLE 16

The following was added to the formulation of Example 14:

300 mg/liter β-naphtholalkoxylate with n=13 and m=0

The resultant coating obtained was a bright, well-smoothed deposit.

What is claimed is:

1. An aqueous acid bath for galvanic deposition of bright, and smooth copper coatings which avoids fine pitting comprising:

a) a β-naphtholalkoxylate of the formula

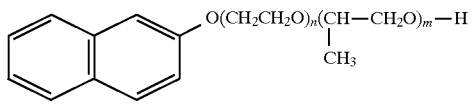

wherein n=0–50, m=0–50 and n+m>3.

b) at least one polymer phenazonium compound;

c) copper sulfate;

d) one or more of an organic nitrogen-free thiocompound; and e) polyethylene glycol present in a concentration from 0.05 to 5 g/liter.

2. The bath according to claim 1, wherein the β-naphtholalkoxylate is selected from the group consisting of β-Naphthol-tetracosa(ethoxylate),
β-Naphthol-eicosa(ethoxylate),
β-Naphthol-octadeca(ethoxylate),
β-Naphthol-hexadeca(ethoxylate),
β-Naphthol-tetradeca(ethoxylate),
β-Naphthol-trideca(ethoxylate),
β-Naphthol-dodeca(ethoxylate),
β-Naphthol-deca(ethoxylate),
β-Naphthol-octa(ethoxylate),
β-Naphthol-hexa(ethoxylate),
β-Naphthol-tetracosa(propoxylate),
β-Naphthol-tetracosa(ethoxy)-mono(propoxylate),
β-Naphthol-octadeca(ethoxy)-di(propoxylate),
β-Naphthol-mono(propoxy)-tetracosa(ethoxylate),
β-Naphthol-di(propoxy)-octadeca(ethoxylate),
and mixtures thereof.

3. The bath according to claim 2, wherein the β-naphtolalkoxylate is present in a concentration from 0.005 to 3 g/liter.

4. The bath according to claim 1, wherein the at least one polymer phenazonium compound is selected from the group consisting of Poly(6-methyl-7-dimethylamino-5-phenyl-phenazonium sulfate),
Poly(2-methyl-7-diethylamino-5-phenyl-phenazonium chloride),
Poly(2-methyl-7-dimethylamino-5-phenyl-phenazonium sulfate),
Poly(5-methyl-7-dimethylamino-phenazonium acetate),
Poly(2-methyl-7-anilino-5-phenyl-phenazonium sulfate),
Poly(2-methyl-7-dimethylamino-phenazonium sulfate),
Poly(7-methylamino-5-phenyl-phenazonium acetate),
Poly(7-ethylamino-2,5-diphenyl-phenazonium chloride),
Poly(2,8-dimethyl-7-diethylamino-5-p-tolyl-phenazonium chloride),
Poly(2,5,8-triphenyl-7-dimethylamino-phenazonium sulfate),
Poly(2,8-dimethyl-7-amino-5-phenyl-phenazonium sulfate),
Poly(7-Dimethylamino-5-phenyl-phenazonium chloride), and mixtures thereof.

5. The bath according to claim 1, wherein the at least one polymer phenazonium compound is present in a concentration from 0.0001 to 0.5 g/liter.

6. The bath according to claim 1, wherein the organic nitrogen-free thiocompound has water-soluble hydrophilic groups and is selected from the group consisting of 3-Mercaptopropane-1-sulfonic acid, sodium salt,
Thiophosphoric acid-O-ethyl-bis-(w-sulfopropyl)-ester, disodium salt,
Thiophosphoric acid-tris-(w-sulfopropyl)-ester, trisodium salt,
Ethylenedithio-dipropylsulfonic acid, sodium salt,
Di-n-propylthioether-di-w-sulfonic acid, disodium salt,
Bis-(w-sulfopropyl)disulfide, disodium salt,
Bis(w-sulfohydroxypropyl)disulfide, disodium salt,
Bis(w-sulfobutyl)disulfide, disodium salt,
Methyl-(w-sulfopropyl)disulfide, sodium salt,
Methyl-(w-sulfobutyl)trisulfide, sodium salt,
and mixtures thereof.

7. The bath according to claim 6, wherein the organic nitrogen-free thiocompounds with water-soluble hydrophilic groups are present in a concentration from 0.0005 to 0.2 g/liter.

8. The bath according to claim 1, further comprising at least one compound selected from the group consisting of thiourea, thiourea derivatives and heterocyclic compounds containing S and N.

9. The bath according to claim 8, wherein the thiourea derivatives and heterocyclic compounds containing S and N are selected from the group consisting of N-Acetylthiourea,
N-Trifluoroacetylthiourea,
N-Ethylthiourea,
N-Cyanoacetylthiourea,
N-Allylthiourea,
O-Tolylthiourea,
N,N'-Butylenethiourea,
Thiazolidinethiol (2),
4-Thiazolinethiol (2),
Imidazolidinethiol (2) (N,N'-Ethylenethiourea),
4-Methyl-2-pyrimidinethiol,
2-Thiouracil,
and mixtures thereof.

10. The bath according to claim 9, wherein the thiourea, thiourea derivatives and heterocyclic compounds containing S and N are present in a concentration of 0.0001 to 0.5 g/liter.

11. An aqueous acid bath for galvanic deposition of bright and smooth copper coatings which avoids fine pitting comprising:

a) a β-naphtholalkoxylate of the formula

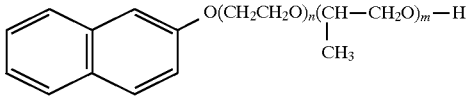

wherein n=0–50, m=0–50 and n+m=>3;

b) at least one polymer phenazonium compound;

c) copper sulfate;

d) one or more of an organic nitrogen-free thiocompound; and e) at least one oxygen-containing high-molecular compound present in a concentration from 0.005 to 5 g/liter.

12. The bath according to claim 11, wherein the at least one oxygen-containing high-molecular compound is selected from the group consisting of Polyvinylalcohol,
Carboxymethylcellulose,
Polyethyleneglycol,
Polypropyleneglycol,
Stearic acid-polyglycolester,
Oleic acid-polyglycolester,
Stearic acid-polyglycolester,
Oleic acid-polyglycolester,
Stearylalcohol-polyglycolether,
Nonylphenyol-polyglycolether,
Octonalpolyalkylene-glycolether,
Octandiol-bis(polyalkyleneglycolether),
Polyoxypropyleneglycol,
Polyethylene-propyleneglycol,
and mixtures thereof.

13. The bath according to claim 12, wherein the at least one oxygen-containing high-molecular compound is present in a concentration from 0.05 to 5 g/liter.

14. A process for galvanic deposition of bright and smooth copper coatings which avoids fine pitting, comprising the steps of:

a) providing an electrolyte bath comprising an aqueous acid bath including:

i) a β-naphtholalkoxylate of the formula

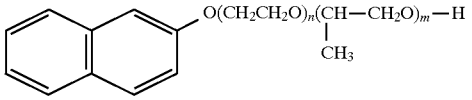

wherein n=0–50, m=0–50 and n+m>3;

ii) at least one polymer phenazonium compound;

iii) copper sulfate;

iv) one or more of an organic nitrogen-free thiocompound; and v) at least one oxygen-containing high-molecular compound present in a concentration from 0.005 to 5 g/liter; and b) applying a cathodic current density of from about 0.5 to about 12 A/dm$^2$.

15. The process of claim 14, further including the step of agitating the electrolyte bath.

16. The process of claim 15, wherein the cathodic current applied in step (b) is from about 2 to about 4 A/dm$^2$.

17. The process of claim 16, further including the step of maintaining said electrolyte bath at a temperature of from about 15° C. to about 45° C.

18. The process of claim 17, wherein the step of agitating said electrolyte bath further includes the step of administering a current of air in the bath.

19. The process of claim 18, wherein the β-naphtholalkoxylate is selected from the group consisting of β-Naphthol-tetracosa(ethoxylate), β-Naphthol-eicosa(ethoxylate), β-Naphthol-octadeca(ethoxylate), β-Naphthol-hexadeca(ethoxylate), β-Naphthol-tetradeca(ethoxylate), β-Naphthol-trideca(ethoxylate), β-Naphthol-dodeca(ethoxylate), β-Naphthol-deca(ethoxylate), β-Naphthol-octa(ethoxylate), β-Naphthol-hexa(ethoxylate), β-Naphthol-tetracosa(propoxylate), β-Naphthol-tetracosa(ethoxy)mono(propoxylate), β-Naphthol-octadeca(ethoxy,)di(propoxylate), β-Naphthol-mono(propoxy)-tetracosa(ethoxylate), β-Naphthol-di(propoxy)-octadeca(ethoxylate), and mixtures thereof.

20. The process of claim 19 wherein the step of providing an electrolyte bath includes providing a bath wherein the β-naphtholalkoxylate is present in a concentration from 0.005 to 3 g/liter.

21. The process of claim 20, wherein the step of providing an electrolyte bath includes providing a bath wherein at least one polymer phenazonium compound is selected from the group consisting of Poly(6-methyl-7-dimethylamino-5-phenyl-phenazonium sulfate), Poly(2-methyl-7-dimethylamino-5-phenyl-phenazonium chloride), Poly(2-methyl-7-dimethylamino-5-phenyl-phenazonium sulfate), Poly(5-methyl-7-dimethylamino-phenazonium acetate), Poly(2-methyl-7-anilino-5-phenyl-phenazonium sulfate), Poly(2-methyl-7-dimethylamino-phenazonium sulfate), Poly(7-methylamino-5-phenyl-phenazonium acetate), Poly(7-ethylamino-2,5-diphenyl-phenazonium chloride), Poly(2,8-dimethyl-7-diethylamino-5-p-tolyl-phenazonium chloride), Poly(2,5,8-triphenyl-7-dimethylamino-phenazonium sulfate), Poly(2,8-dimethyl-7-amino-5-phenyl-phenazonium sulfate), Poly(7-Dimethylamino-5-phenyl-phenazonium chloride), and mixtures thereof.

22. The process of claim 21, wherein the step of providing an electrolyte bath includes providing a bath wherein at least one polymer phenazonium compound is present in a concentration from 0.0001 to 0.5 g/liter.

23. The process of claim 14, wherein the step of providing an electrolyte bath includes providing a bath wherein at least one oxygen-containing high-molecular compound is selected from the group consisting of Polyvinylalcohol, Carboxymethylcellulose, Polyethyleneglycol, Polypropyleneglycol, Stearic acid-polyglycolester, Oleic acid-polyglycolester, Stearic acid-polyglycolester, Oleic acid-polyglycolester, Stearylalcohol-polyglycolether, Nonylphenyol-polyglycolether, Octonalpolyalkylene-glycolether, Octandiol-bis(polyalkyleneglycolether), Polyoxypropyleneglycol, Polyethylene-propyleneglycol, and mixtures thereof.

24. The process of claim 23, wherein the step of providing an electrolyte bath includes providing a bath wherein at least one oxygen-containing high-molecular compound is present in a concentration from 0.05 to 5 g/liter.

25. The process of claim 24, wherein the step of providing an electrolyte bath includes providing a bath wherein the organic nitrogen-free thiocompound has water-soluble hydrophilic groups and is selected from the group consisting of 3-Mercaptopropane-1-sulfonic acid, sodium salt, Thiophosphoric acid-O-ethyl-bis-(w-sulfopropyl)-ester, disodium salt, Thiophosphoric acid-tris-(w-sulfopropyl)-ester, trisodium salt, Ethylenedithio-dipropylsulfonic acid, sodium salt, Di-n-propylthioether-di-w-sulfonic acid, disodium salt, Bis-(w-sulfopropyl)disulfide, disodium salt, Bis(w-sulfohydroxypropyl)disulfide, disodium salt, Bis(w-sulfobutyl)disulfide, disodium salt, Methyl-(w-sulfopropyl)disulfide, sodium salt, Methyl-(w-sulfobutyl)trisulfide, sodium salt, O and mixtures thereof.

26. The process of claim 25, wherein the step of providing an electrolyte bath includes providing a bath wherein the organic nitrogen-free thiocompounds with water-soluble hydrophilic groups are present in a concentration from 0.0005 to 0.2 g/liter.

27. The process of claim 26, wherein the step of providing an electrolyte bath further comprising at least one compound selected from the group consisting of thiourea, thiourea derivatives and heterocyclic compounds containing S and N.

28. The process of claim 27, wherein the step of providing an electrolyte bath includes providing a bath wherein the thiourea derivatives and heterocyclic compounds containing S and N are selected from the group consisting of N-Acetylthiourea, N-Trifluoroacetylthiourea,
N-Ethylthiourea,
N-Cyanoacetylthiourea,
N-Allylthiourea,
O-Tolylthiourea,
N,N'-Butylenethiourea,
Thiazolidinethiol (2),
4-Thiazolinethiol (2),
Imidazolidinethiol (2) (N,N'-Ethylenethiourea),
4-Methyl-2-pyrimidinethiol,
2-Thiouracil,
and mixtures thereof.

29. The process of claim 28, wherein the step of providing a electrolyte bath includes providing a bath wherein the thiourea, thiourea derivatives and heterocyclic compounds containing S and N are present in a concentration of 0.0001 to 0.5 g/liter.

30. A process for galvanic deposition of bright and smooth copper coatings which avoids fine pitting, comprising the steps of:

a) providing an electrolyte bath having a pH range comprising an aqueous acid bath including:

i) a β-naphtholalkoxylate of the formula

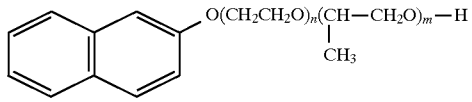

wherein n=0–50, m0–50 and n+m>3;

ii) at least one polymer phenazonium compound;

iii) copper sulfate;

iv) one or more of an organic nitrogen-free thiocompound; and v) polyethylene glycol in a concentration from 0.05 to 5.0 g/liter;

b) applying a cathodic current density of from about 0.5 to about 12 A/dm$^2$;

c) maintaining a temperature of the bath of from 15° C. to 45° C.; and d) maintaining the pH of the bath at a value of 1 or less.

* * * * *